US007429906B2

(12) United States Patent
Korczynski

(10) Patent No.: US 7,429,906 B2
(45) Date of Patent: Sep. 30, 2008

(54) OVERCURRENT DEVICE FEED THROUGH JUNCTION BLOCK

(75) Inventor: Jacek Michael Korczynski, Niles, IL (US)

(73) Assignee: Cooper Technologies Company, Houston, TX (US)

( * ) Notice: Subject to any disclaimer, the term of this patent is extended or adjusted under 35 U.S.C. 154(b) by 281 days.

(21) Appl. No.: 11/044,512

(22) Filed: Jan. 27, 2005

(65) Prior Publication Data

US 2006/0164192 A1 Jul. 27, 2006

(51) Int. Cl.
*H01H 75/00* (2006.01)

(52) U.S. Cl. ..... 335/6; 335/8

(58) Field of Classification Search ..... 335/6, 335/8

See application file for complete search history.

(56) References Cited

U.S. PATENT DOCUMENTS 5,004,994 A 4/1991 Korczynski et al.
5,021,761 A 6/1991 Stack et al.
5,088,940 A * 2/1992 Saito ..... 439/620.34
5,700,165 A * 12/1997 Harris et al. ..... 439/620.26
6,002,580 A 12/1999 LeVantine et al.
6,218,040 B1 4/2001 Romero
6,322,376 B1 11/2001 Jetton
6,431,880 B1 8/2002 Davis et al.
6,456,188 B1 * 9/2002 Tsuchiya ..... 337/235
6,624,990 B1 * 9/2003 Lortscher ..... 361/42
6,976,866 B2 * 12/2005 Jaschke et al. ..... 439/402

* cited by examiner

*Primary Examiner*—Elvin Enad
*Assistant Examiner*—Bernard Rojas
(74) *Attorney, Agent, or Firm*—King & Spalding LLP

(57) ABSTRACT

An electrical feed through junction block includes a mountable housing comprising a front and a back, a first conductive terminal extending from the front of the housing, a second conductive terminal extending from the housing in a direction opposite the first conductive terminal, and an overcurrent protection device located within the housing. The overcurrent protection device is configured to provide a conductive path between the first conductive terminal and the second conductive terminal when in a non-overcurrent position.

24 Claims, 6 Drawing Sheets

OVERCURRENT DEVICE FEED THROUGH JUNCTION BLOCK

BACKGROUND OF THE INVENTION

This invention relates generally to electrical power distribution blocks, and more specifically, to electrical power distribution utilizing feed through junction blocks.

Feed through junction blocks are utilized, in one example, in the routing of electrical power from one side of a barrier to another. Utilization of such feed through junction blocks provides for a neat, clean, and electrically sound interconnection between circuits on each side of such a barrier. An example of such a barrier is the firewall between the engine compartment and passenger compartment of a vehicle. Such feed through junction blocks often incorporate threaded studs which allows one or more ring terminals to be secured to the stud utilizing, for example, a washer and a nut.

While it is possible to simply run a wire through a firewall, problems exist with such a configuration. One problem is that it is difficult to secure a wire that passes through a hole in the firewall. Such an installation also tends to compromise the barrier between the two compartments. Also, vibration may cause a hole to be worn through the insulation of such a wire passing through a hole in a firewall, leading to electrical shorts and other electrical system malfunctions.

Known feed through junction blocks partially address the difficulties associated with running electrical circuits through barriers as they include a mounting plate. Such junction blocks are typically fastened to the barrier with a plurality of fasteners that extend through the barrier and the mounting plate. While known feed through junction blocks provide a securely mounted electrical connection between circuits on opposite sides of a barrier, such feed through junction blocks are typically utilized with circuit protection devices discretely wired to the junction block, for example, circuit breakers and fuses. The location of connecting terminals in known circuit protection devices, particularly circuit breakers, which are panel (or firewall) mountable makes it difficult to wire the device to the junction block and the circuit to be protected. This problem is particularly acute in installations where access is restricted, such as vehicle firewall installations.

BRIEF DESCRIPTION OF THE INVENTION

In one aspect, an electrical feed through junction block is provided that comprises a mountable housing comprising a front and a back, a first conductive terminal extending from the front of the housing, a second conductive terminal extending from the housing in a direction opposite the first conductive terminal, and an overcurrent protection device located within the housing. The overcurrent protection device is configured to provide a conductive path between the first conductive terminal and the second conductive terminal when in a non-overcurrent position.

In another aspect, a circuit breaker is provided that comprises a bimetallic element comprising a contact thereon, a first conductive terminal in electrical contact with the bimetallic element, a second conductive terminal comprising an electrical contact formed on an end thereof, the electrical contact configured to the electrical contact on the bimetallic element, and a mountable housing. The first conductive terminal extends from the housing, and the second conductive terminal extends from the housing in a direction opposite the first conductive terminal.

DETAILED DESCRIPTION OF THE INVENTION

Figure 1:
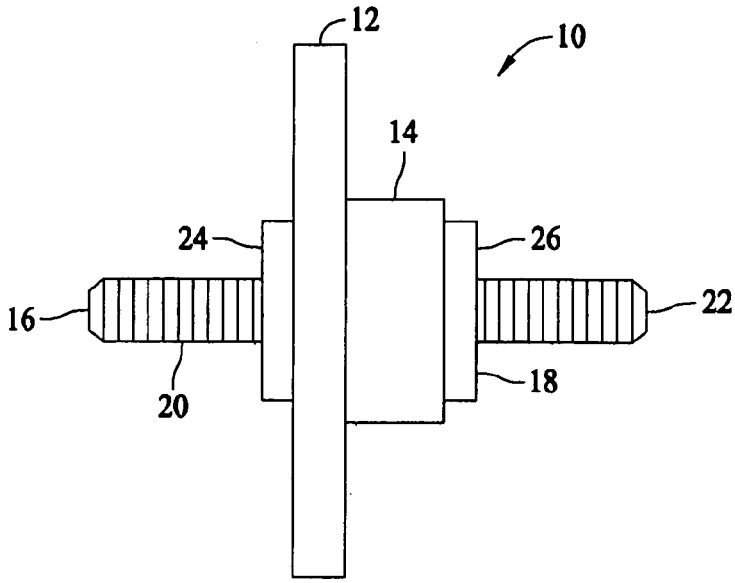
FIG. 1 PRIOR ART
FIG. 1 is a side view of a feed through junction block.

FIG. 1 is a side view of a feed through junction block 10. The junction block 10 includes a mounting plate 12 which is utilized in the mounting of the junction block 10 as further described below. Formed as part of the mounting plate 12 is an insulating extension 14. The insulating extension 14 is hollow to allow insertion of a conducting member 16. The conducting member 16 includes a plate engaging unit 18 which extends through the hollow portion of the mounting plate 12. A first threaded stud 20 and a second threaded stud 22 extend from opposite ends of the plate engaging unit 18. In one embodiment, the plate engaging unit 18, the first threaded stud 20, and the second threaded stud 22 are formed as a single piece.

In the embodiment illustrated, the insulating extension 14 is configured to engage a hole formed in, for example, an automotive firewall, to which the junction block 10 is to be mounted. Therefore, the insulating extension 14 insulates the conducting member 16 from the firewall. The plate engaging unit 18 includes a first end 24 and a second end 26 each of which is a substantially flat surface that provides for adequate electrical connection between the junction block 10 and a conductor attached to the junction block 10, for example, a ring terminal (not shown) that has been secured against one of the ends 24 and 26 by the engagement of a nut (or a washer and a nut) onto a respective one of the first threaded stud 20 and the second threaded stud 22.

Figure 2:
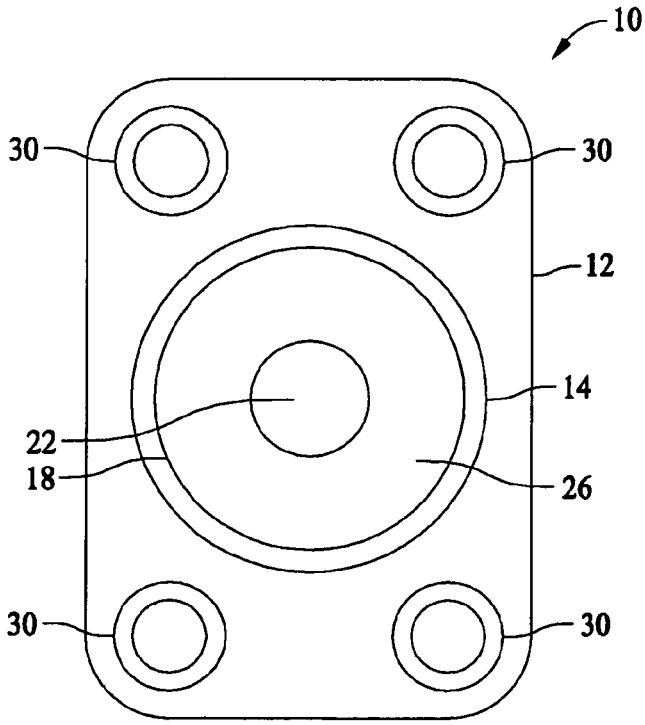
FIG. 2 PRIOR ART
FIG. 2 is a front view of the feed through junction block of FIG. 1.

FIG. 2 is a front view of the feed through junction block 10 of FIG. 1 illustrating the flat surface of the second end 26 of the plate engaging unit 18, and the mounting plate 12. More specifically, the mounting plate 12 is substantially rectangular in shape and includes a plurality of mounting holes 30 formed therein. The mounting holes 30 are utilized to mount the junction block 10 to a surface, for example, the above described vehicle firewall. The mounting holes 30 are utilized with preformed holes in the surface to which the junction block 10 is to be mounted, such that a nut, bolt, or fastener can be used to retain the junction block in position on the surface. Alternatively, self tapping fasteners may be inserted through the mounting holes 30 and engaged into the surface to which the junction block 10 is to be mounted with, for example, threaded engagement. As described above, the insulating extension 14 is inserted into a pre-formed hole, then the mounting holes are utilized in mounting the junction block 10.

As described, the feed through junction block 10 provides an efficient mechanism for the transfer of electrical power from one side of, for example, a firewall to the other side of the firewall with a minimal effect on the integrity of such a firewall. Circuit protection devices, however, must be discretely or individually wired between the feed through junction block 10 and the circuits which receive power via feed through junction block 10. Wiring of the circuit protection devices to such junction blocks is difficult due to space restrictions in the vicinity of the firewall, leading to increased time and labor costs to establish electrical connections to the electrical system. Additionally, installation difficulties may present reliability issues if electrical connections are not properly established.

Figure 3:
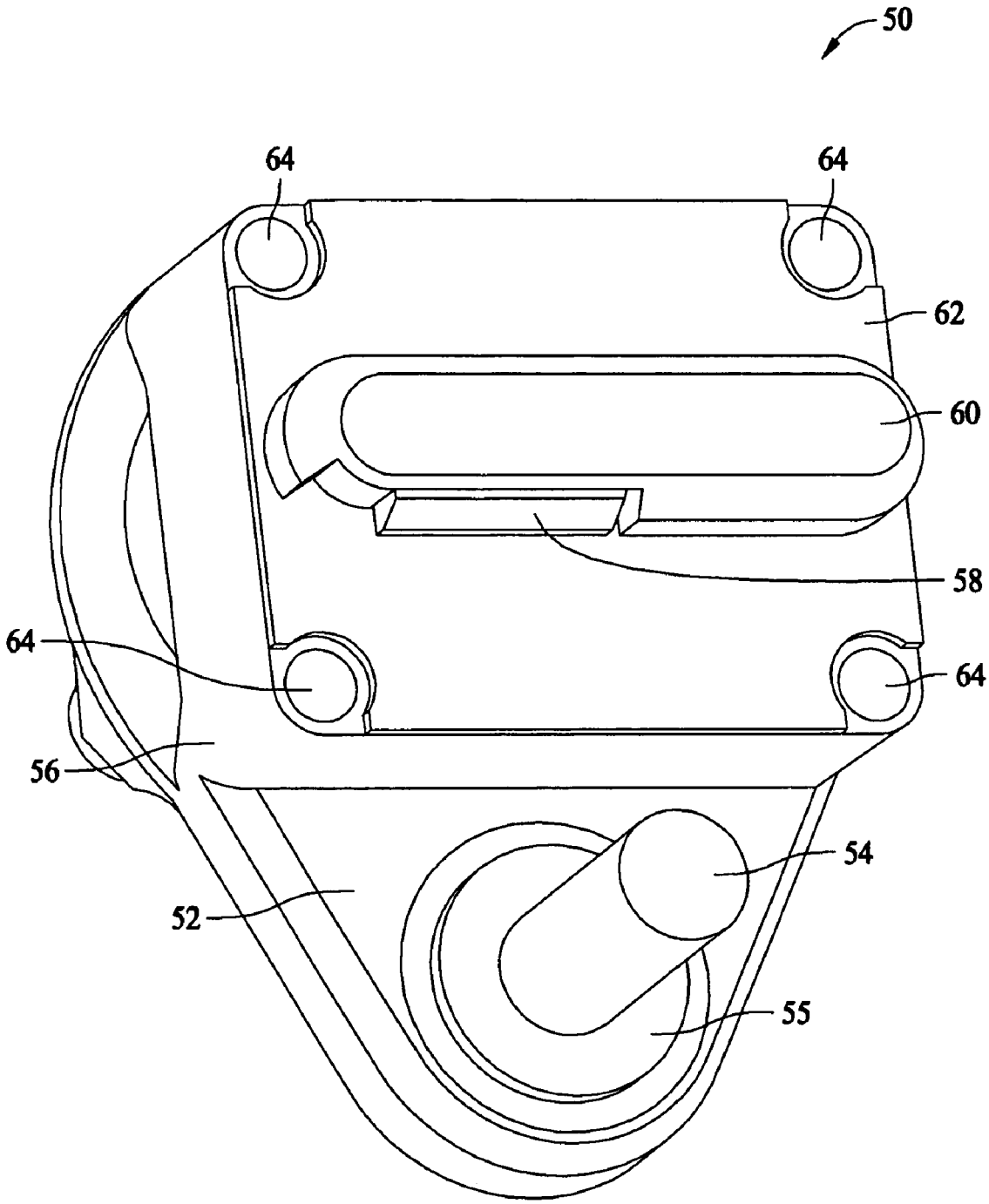
FIG. 3 is a front view of a feed through junction block incorporating a circuit breaker.

FIG. 3 is a front view of an exemplary feed through junction block 50 incorporating an overcurrent protection device, such as a circuit breaker, and which avoids the aforementioned issues with separately wired overcurrent protection devices. By providing an integrated overcu ay be more quickly and more conveniently installed in an electrical system, thereby rrent protection device in the feed through junction block 50, the junction block 50 m lowering installation costs and increasing system reliability.

In an exemplary embodiment, the feed through junction block 50 includes a mountable chassis 52, and a first conductive stud 54 extending from the mountable chassis 52 which is operable as a first circuit breaker contact. In one embodiment, the first conductive stud 54 is a threaded stud configured to be engaged by a washer and nut. In one embodiment, the first conductive stud 54 extends from a conductive base plate 55 which has a diameter larger than a diameter of the first conductive stud 54. The conductive base plate 55 is substantially flat and its surface is raised slightly from that of the mountable chassis. The conductive base plate 55 is particularly useful for providing an adequate electrical connection to conductors that are attached to the first conductive stud 54. One example of such a conductor is a ring terminal (not shown), having a surface that comes into substantial contact with the conductive base plate 55.

A tripping element housing 56 is formed as a portion of the mountable chassis 52 and partially provides an area for internal components relating to operation of a reset handle 58 and a protective member 60 or guard for reset handle 58 which extend through a tripping element housing cover 62. The tripping element housing cover 62 is secured to the tripping element housing 56 utilizing multiple fastening devices, for example, rivets 64. In another embodiment (not shown), the feed through junction block 50 and tripping element housing 56 may be configured with a manual tripping element and a protective member similar to protective member 60 to provide protection for the manual tripping element.

Figure 4:
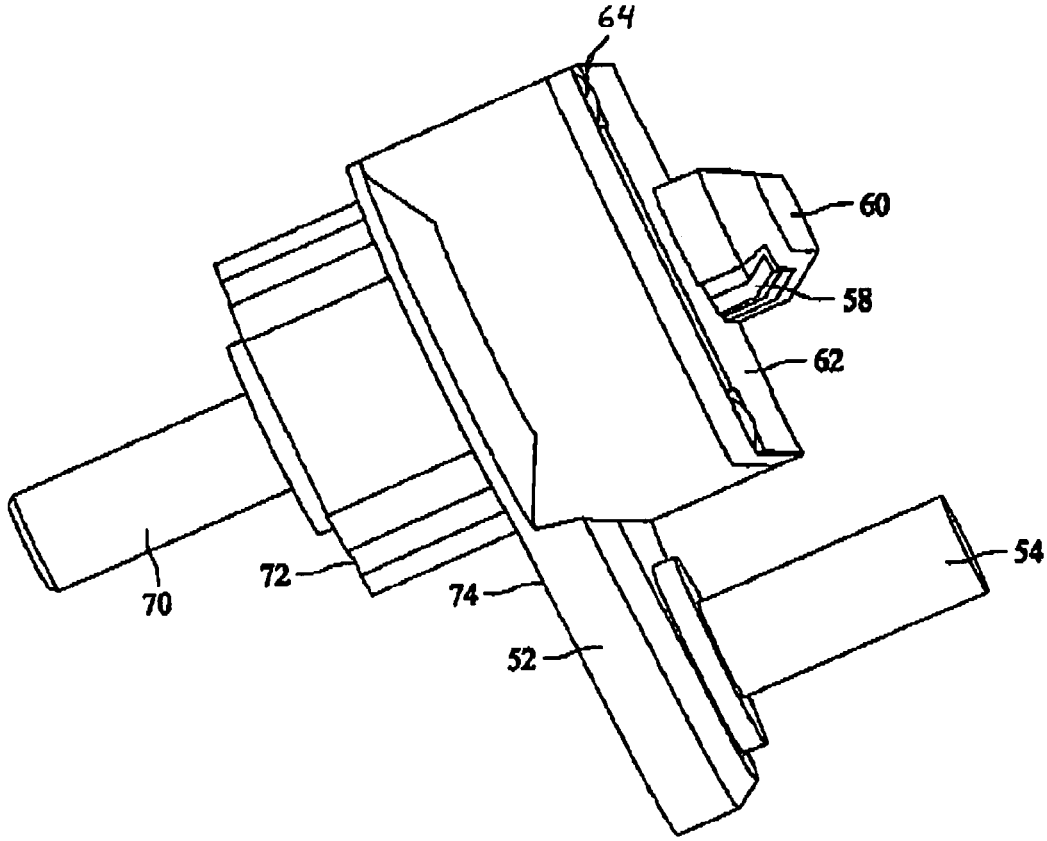
FIG. 4 is a side view of the feed through junction block of FIG. 3.

FIG. 4 is a side view of the feed through junction block 50. The feed through junction block 50 further includes a second conductive stud 70 which extends from an insulating extension 72 formed as a portion of the mountable chassis 52. The insulating extension 72 extends from a substantially flat mounting surface 74 of the mountable chassis 52. For mounting the feed through junction block 50, the second conductive stud 70 and the insulating extension 72 are inserted through an opening of, for example, an automotive firewall such that the flat mounting surface 74 engages the firewall, Upon the mounting of the feed through junction block 50, the first conductive stud 54 is accessible from one side of the firewall and the second conductive stud 70 is accessible from the other side of the firewall. In the embodiment, the first conductive stud 54 and the second conductive stud 70 are offset from one another (e.g., the longitudinal axes are spaced from one another). The offset results in a space within mountable chassis 52 for insertion of the overcurrent protection device as described herein.

Figure 5:
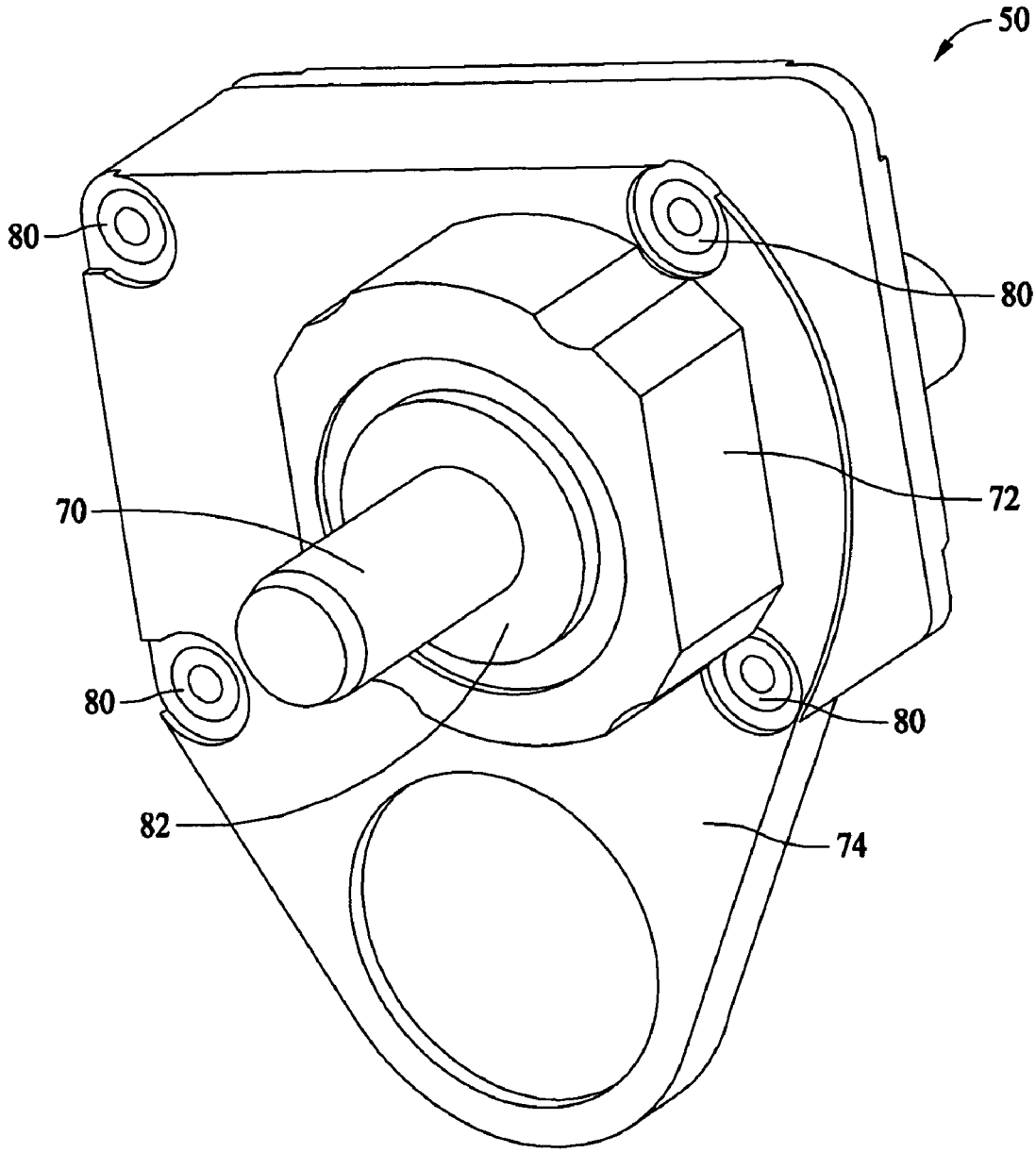
FIG. 5 is a rear view of the feed through junction block of FIG. 3.

FIG. 5 is a rear view of the feed through junction block 50 which better illustrates the contours, at least of the embodiment illustrated, of the substantially flat mounting surface 74. In the embodiment, a back side 80 of the rivets 64 are threaded for surface mounting of the feed through junction block 50. In one embodiment, the second conductive stud 70 extends from a conductive base plate 82 which has a diameter larger than a diameter of the second conductive stud 70. The conductive base plate 82 is substantially flat and its surface is raised slightly from that of the insulating extension 82. As described with respect to the conductive base plate 55 (shown in FIG. 3), the conductive base plate 82 is particularly useful for providing an adequate electrical connection to conductors that are attached to the second conductive stud 70.

Figure 6:
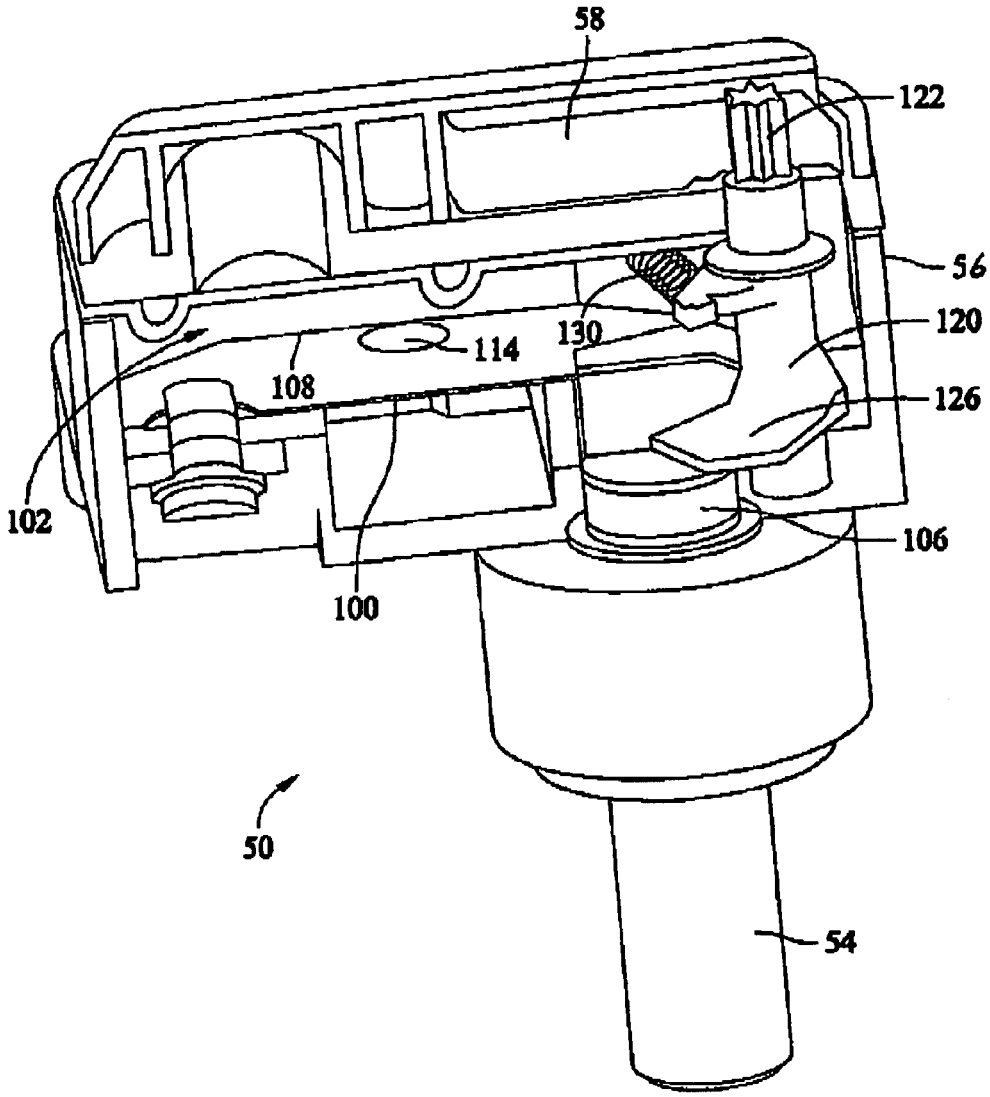
FIG. 6 is a cross-sectional view illustrating the internal components of the feed through junction block of FIG. 3.

FIG. 6 is a cross-sectional view illustrating the internal components of the feed through junction block 50. Referring to operable components for a circuit breaker within the feed through junction block 50, a bimetallic, bistable, thermally activated element 100 is mounted within a cavity 102 formed by the mountable chassis 52. The bistable element 100 is manufactured to have a predetermined overcurrent snap action. The bistable element 100 is illustrated in a non-overcurrent condition, specifically, in a first relatively straight position. When there is an overcurrent, the bistable element 100 heats up and deflects to snap into a second position (not shown). The bistable element extends from a first end (not shown) that is attached to an internal portion 106 of the first conductive stud 54 to a second end 108 whose position is substantially in line with the second conductive stud 70 (not shown in FIG. 6). Further description of similar components utilized in the circuit breaker portion of the feed through junction block 50 and operation of such a circuit breaker is included within U.S. Pat. No. 5,021,761 which is incorporated by reference herein.

As described above, the bistable element 100 is manufactured to have a predetermined overcurrent snap action. Upon an overcurrent condition, the bistable element 100 heats up and deflects to a second position (not shown) to separate the contact between the bistable element 100 and internal portion 106 of the first conductive stud 54, thereby interrupting the flow of current through the feed through junction block 50. A manual reset shaft 120 extends through mountable chassis 52 for use by an operator at a first end 122 where reset handle 58 is attached. A second end 126 of manual reset shaft 120 is configured to return the bistable element 100 to the non-overcurrent position. In one embodiment, operation of the bistable element 100 causes the reset handle 58 to rotate to indicate the circuit breaker has tripped upon an overcurrent condition. In another embodiment, a spring 130 is attached to shaft 120 and moves to an extended position when the reset handle 58 is moved back to the untripped position. The bistable element 100 is configured to cool quickly after tripping, and utilization of the reset handle 58 causes a force to be applied to a portion of the bistable element 100 causing it to return to a first relatively straight position.

It should be understood that the scope of the feed through junction blocks are not limited in scope to the embodiments described herein. Other embodiments which incorporate other circuit breaker configurations, including, but not limited to other manual reset circuit breakers, push-to-trip circuit breakers (which include components within the mountable chassis to move the bistable element), automatic reset circuit breakers, and modified reset circuit breakers (which utilize a resistor to keep the bistable element in the open state after a trip) are considered to be within the scope of the invention. In addition, those skilled in the art will recognize that fuse configurations may also be employed.

Figure 7:
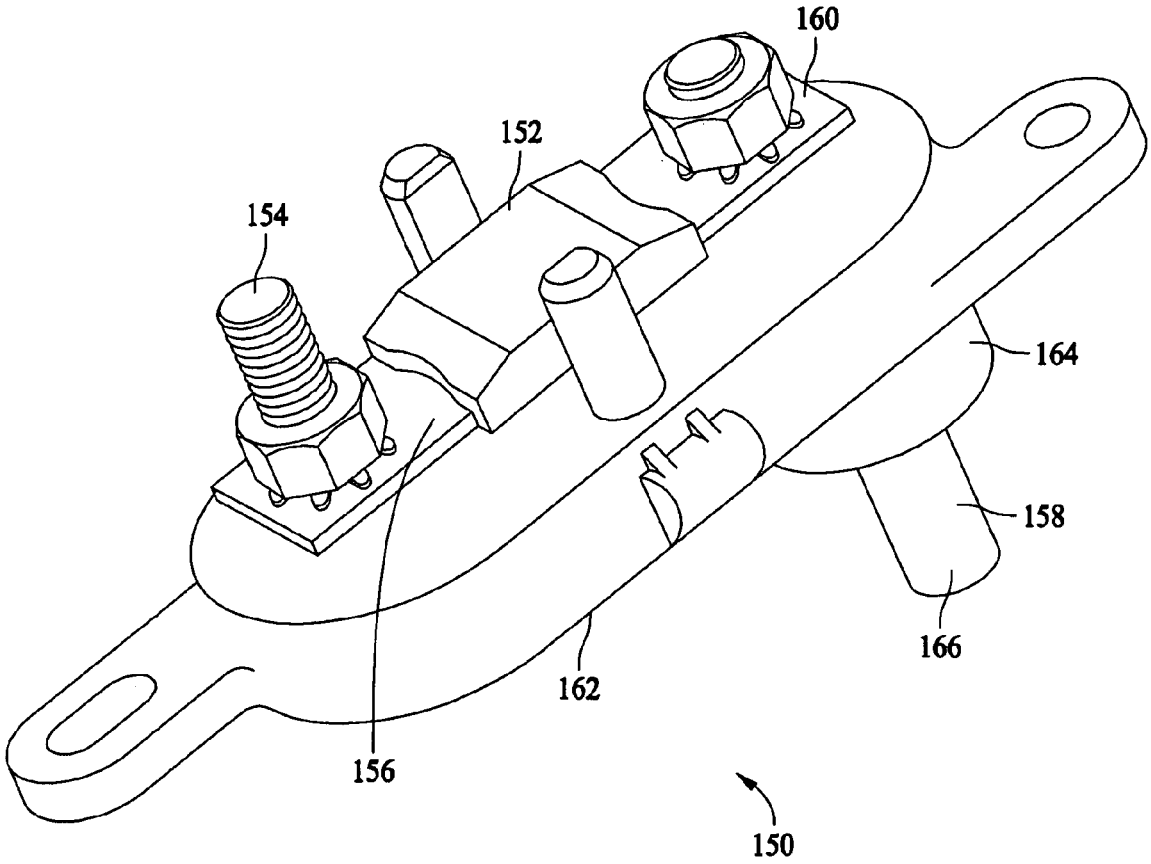
FIG. 7 is a schematic view of a feed through junction block which incorporates a fuse.

More specifically, FIG. 7 is an illustration of a feed through junction block 150 which incorporates a fuse 152. Feed through junction block 150 includes a first conductive stud 154 to which a first contact 156 of fuse 152 is attached and a second conductive stud 158 to which a second contact 160 of fuse 150 is attached. Similarly to the embodiments described above, a mountable chassis 162 of feed through junction block 150 includes an insulating extension 164 which is hollowed allowing for insertion of a first end 166 of second conductive stud 158. Insulating extension 164 is configured to engage, for example, a hole in a firewall to which feed through junction block 150 is to be mounted. A second end 168 of second conductive stud 158 extends through mountable chassis 162 in order to engage the second contact 160 of fuse 152. As those in the art will appreciate, the fuse 152 includes a fusible link or fuse element assembly which is constructed to physically melt, disintegrate, sever, or otherwise fail upon specified current conditions, thereby opening the circuit through the fuse 152 between the conductive studs 154, 158. A wide variety of fuses may be used for such purposes to meet desired specifications. Other known overcurrent protection devices, not limited to fuses or circuit breakers, could be employed in alternative embodiments in lieu of the above described circuit breaker and fuse embodiments.

The feed through junction blocks 50 and 150 provide an efficient mechanism for the transfer of electrical power from one side of a firewall to the other side of the firewall with a minimal effect on the integrity of such a firewall. In addition, the feed through junction blocks 50 and 150 provides overcurrent protection for circuits that receive power through the feed through junction blocks. Utilizing the feed through junction blocks 50 and 150 allow for the protection of circuits without having to individually wire discrete components (i.e., fuses or circuit breakers) between the feed through junction block and the circuits being powered via the feed through junction block.

As described, the feed through junction blocks 50 and 150 provide an efficient mechanism for the transfer of electrical power while incorporating a circuit protection device. Incorporation of such a device overcomes the above described problems associated with discretely wired circuit protection devices, including, but not limited to, space restrictions and increased time and labor costs to establish electrical connections to an electrical system. As such, the compact package of feed through junction blocks 50 and 150 saves space in comparison to separate junction blocks and overcurrent protection devices which are wired together in an electrical system.

While the invention has been described in terms of various specific embodiments, those skilled in the art will recognize that the invention can be practiced with modification within the spirit and scope of the claims.

What is claimed is:

1. An electrical feed through junction block comprising:

a mountable housing comprising a front and a back, said back comprising a substantially flat mounting surface;

a first conductive terminal extending from said front of said housing, a second conductive terminal extending from said back of said housing, wherein the configuration of said housing is such that when said second conductive terminal is inserted through an aperture in a barrier, said mounting surface engages said barrier and said first conductive terminal and said second conductive terminal are on opposite sides of said barrier; and an overcurrent protection device located within said housing, wherein said overcurrent protection device provides a conductive path between said first conductive terminal and said second conductive terminal when in a non-overcurrent operating condition, wherein said overcurrent protection device comprises a circuit breaker having a bimetallic element extending between said first conductive terminal and said second conductive terminal.

2. An electrical feed through junction block according to claim 1 further comprising an insulating extension formed as a portion of said housing; and wherein said second conductive terminal extends from said insulating extension.

3. An electrical feed through junction block according to claim 1 further comprising an insulating extension formed as a portion of said housing; and wherein said insulating extension is shaped to extend through said aperture.

4. An electrical feed through junction block according to claim 1 wherein said housing comprises an opening formed therein; and wherein said feed through junction block further comprises a reset handle extending through said opening, wherein said reset handle closes said overcurrent protection device when in a first position and indicates that said overcurrent protection device has opened when in a second position.

5. An electrical feed through junction block according to claim 1 wherein said housing comprises an opening formed therein;

wherein said feed through junction block further comprises a reset handle and a protective member extending through said opening, wherein said reset handle closes said overcurrent protection device when in a first position and indicates that said overcurrent protection device has opened when in a second position; and wherein said protective member is substantially adjacent said reset handle.

6. An electrical feed through junction block according to claim 1 wherein said overcurrent protection device comprises a fuse.

7. An electrical feed through junction block according to claim 1 wherein each of said first conductive terminal and said second conductive terminal comprises a threaded stud.

8. An electrical feed through junction block according to claim 1 wherein each of said first conductive terminal and said second conductive terminal comprises:

a conductive base plate extending from said housing and a conductive threaded stud extending from said conductive base plate; and wherein a diameter of said conductive threaded stud is smaller than a diameter of said conductive base plate, so as to provide adequate electrical connection to a conductor attached to said threaded stud.

9. An electrical feed through junction block according to claim 1 wherein a longitudinal axis of said first conductive terminal and a longitudinal axis of said second conductive terminal are separated by a distance.

10. An electrical feed though junction block comprising:

a mountable housing comprising a front and a back;

a first conductive terminal extending from said front of said housing;

a second conductive terminal extending from said back of said housing in a direction opposite said first conductive terminal; and an overcurrent protection device located within said mountable housing, said overcurrent protection device designed to provide a conductive path between said first conductive terminal and said second conductive terminal when in a non-overcurrent operating condition;

wherein said overcurrent protection device comprises a circuit breaker having a bimetallic element extending between said first conductive terminal and said second conductive terminal.

11. An electrical, feed though junction block according to claim 10, wherein said back of housing comprises a substantially flat mounting surface; and wherein the configuration of said housing is such that when said second conductive terminal is inserted through an aperture in a barrier, said mounting surface engages said barrier and said first conductive terminal and said second conductive terminal are on opposite sides of said barrier.

12. An electrical feed though junction block according to claim 11 further comprising an insulating extension formed as a portion of said housing;

wherein said second conductive terminal extends from said insulating extension; and wherein said insulating extension and said second conductive terminal are each shaped to extend though said aperture.

13. An electrical feed though junction block according to claim 10, wherein said housing comprises an opening formed therein; and wherein said feed through Junction block further comprises a reset handle extending though said opening, wherein said reset handle closes said overcurrent protection device when in a first position and indicates that said overcurrent protection device has opened when in a second position.

14. An electrical feed through junction block according to claim 13, further comprising a protective member extending through said opening substantially adjacent said reset handle.

15. An electrical feed through junction block according to claim 10, wherein each of said first conductive terminal and said second conductive terminal comprises a threaded stud.

16. An electrical feed through junction block according to claim 10, wherein each of said first conductive terminal and said second conductive terminal comprises:

a conductive base plate extending from said housing and a conductive threaded stud extending from said conductive base plate; and wherein a diameter of said conductive threaded stud is smaller than a diameter of said conductive base plate, so as to provide adequate electrical connection to a conductor attached to said threaded stud.

17. An electrical feed through junction block according to claim 10 wherein said first conductive terminal and said second conductive terminal are offset relative to one another.

18. An electrical feed through junction block according to claim 10, wherein said overcurrent protection device comprises a fuse.

19. An electrical feed Through junction block according to claim 10, wherein said overcurrent protection device comprises at least one of a manual reset circuit breaker, a push-to-trip circuit breaker, an automatically reset circuit breaker, and a modified reset circuit breaker.

20. An electrical feed though junction block according to claim 10, wherein said bimetallic element comprises a contact, wherein said first conductive terminal is in electrical contact with said bimetallic element; and wherein said second conductive terminal comprises an electrical contact formed on an end thereof and configured to engage said contact on said bimetallic element.

21. An electrical feed through junction block according to claim 10, wherein said mountable housing further comprises an insulating extension formed as a portion of said housing, said second conductive terminal extending from said insulating extension.

22. An electrical feed through junction block according to claim 10, further comprising an insulating extension formed as a portion of said mountable housing, said insulating extension configured to extend through an aperture formed in a wall onto which said feed through junction block is configured to be mounted, wherein said second conductive terminal extends from said insulating extension.

23. An electrical feed through junction block according to claim 10, wherein portions of said first conductive terminal and said second conductive terminal extending from said housing each comprise:

a conductive base plate having a diameter and comprising a surface raised from said housing; and a threaded stud extending substantially from a center of said conductive base plate, said threaded stud having a diameter that is less than a diameter of said conductive base plate.

24. An electrical feed through junction block according to claim 10, wherein a longitudinal axis of said first conductive terminal and a longitudinal axis of said second conductive terminal are separated by a distance.

* * * * *